US006823813B2

(12) United States Patent
Mazin

(10) Patent No.: US 6,823,813 B2
(45) Date of Patent: Nov. 30, 2004

(54) LEG-MOUNTED PROPULSION DEVICE FOR SWIMMERS AND DIVERS

(76) Inventor: Benjamin A. Mazin, 860 S. Los Robles Ave., Pasadena, CA (US) 91106

( * ) Notice: Subject to any disclaimer, the term of this patent is extended or adjusted under 35 U.S.C. 154(b) by 0 days.

(21) Appl. No.: 10/469,871

(22) PCT Filed: Mar. 7, 2002

(86) PCT No.: PCT/US02/07139

§ 371 (c)(1),
(2), (4) Date: Sep. 5, 2003

(87) PCT Pub. No.: WO02/072382

PCT Pub. Date: Sep. 19, 2002

(65) Prior Publication Data

US 2004/0094083 A1 May 20, 2004

Related U.S. Application Data

(60) Provisional application No. 60/274,123, filed on Mar. 8, 2001.

(51) Int. Cl.[7] ..... B63C 11/46
(52) U.S. Cl. ..... 114/315; 440/6
(58) Field of Search ..... 114/315, 338; 440/6; 405/185, 186

(56) References Cited

U.S. PATENT DOCUMENTS 3,635,188 A * 1/1972 Rutkowski ..... 440/6
3,745,961 A * 7/1973 Laughman ..... 440/16
3,995,578 A * 12/1976 McCullough ..... 440/6
4,467,742 A * 8/1984 Duboy ..... 114/315
4,700,654 A * 10/1987 Borges ..... 114/338
4,938,722 A * 7/1990 Rizley ..... 440/6
5,024,178 A * 6/1991 Bruce ..... 114/315
5,105,753 A * 4/1992 Chih et al. ..... 114/315
5,984,739 A * 11/1999 Donahue ..... 440/6
6,341,993 B1 * 1/2002 Lalli, Jr. ..... 441/64

OTHER PUBLICATIONS (John Bantin) "Zoom, Zoom, Zoom", Diver Magazine, Nov. 2003, pp. 138–139; Teddington, Middlesex TW11 8HA, England ("as printed" and on–line versions).

* cited by examiner

*Primary Examiner*—Andrew Wright
(74) *Attorney, Agent, or Firm*—Christie, Parker & Hale,LLP

(57) ABSTRACT

An electric motorized propulsion system (10) for swimmers and divers (12) includes pair of leg-mounted propulsion units (14), each containing sealed electric motors (12), propellers (22), and housings (21), attach to the user's legs to provide thrust, manoeuvrability, and hands-fee operation. A control box (18) containing a motor variable speed control (54) is mountable at a convenient place on the swimmer's body. A battery unit, either simulating a diver's weight belt (16) or provided as a cylindrical hard pack (60) is carryable on the back of the swimmer. Electrical power and signal cables (30, 46) connect the control box to the battery unit and to the propulsion motor housings.

17 Claims, 4 Drawing Sheets

LEG-MOUNTED PROPULSION DEVICE FOR SWIMMERS AND DIVERS

REFERENCE TO RELATED APPLICATIONS

This application is the National Stage of International Application PCT/US02/07139 filed 07 Mar. 2002 and claims the benefit thereof. Also, this application claims the benefit of U.S. provisional Application No. 60/274,123 filed Mar. 8, 2001.

FIELD OF THE INVENTION

This invention pertains to propulsion systems for individual swimmers and divers. More specifically, it pertains to an electrically powered swimmer's propulsion system in which a motor-propeller assembly is mountable to at least one of the swimmer's legs.

BACKGROUND OF THE INVENTION

Swimmers and divers often have need to travel longer distances in or under the water than are feasible without an external source of propulsion, whether for recreational, commercial or military purposes. An external propulsion source reduces the air consumption rate, fatigue and chance of decompression sickness for the diver. There are products available to provide powered propulsion for a diver. One kind of product is a powered water sled, a drawback of which is that it requires at least one hand to operate, making it difficult to perform certain tasks such as photography. Another troublesome characteristic of previously described propulsion arrangements is that the units can become lost if they are released when in the water. Also, it has been proposed to mount a propulsion unit to an air tank worn on the back of a scuba diver. While that approach provides propulsion, it does so in a way which does not well serve the diver's need for maneuverability.

Thus, a need exists for a diver's personal powered propulsion system which can be operated in a hands-free manner, which is effective, and which enables a user to have a high degree of maneuverability in and under the water. The equipment comprising the system should be releasable by the user in the event of special need, but otherwise should be attached to the diver.

SUMMARY OF THE INVENTION

This invention addresses the needs identified above. It provides an efficient and effective personal powered propulsion system for swimmers and divers which enables the user to have good maneuverability in and under the water and which, during use, leaves the user's hands free for the performance of desired tasks or actions.

Generally speaking, the invention provides a powered propulsion device for a swimmer or a diver. A propeller and propeller drive electrical motor assembly is adapted to be releasably mounted to a leg of a swimmer. An electrical battery unit is adapted to be supported by the torso of the swimmer. A motor control is provided, as are electrical conductors which are connectible between the motor control, the battery unit, and the propeller motor assembly.

BRIEF DESCRIPTION OF THE DRAWINGS

The above-mentioned and other features and components of the invention are set forth in the following description of illustrative embodiments of the invention, which description is presented with reference to the accompanying drawings in which.

DETAILED DESCRIPTION OF THE INVENTION

Figure 1:
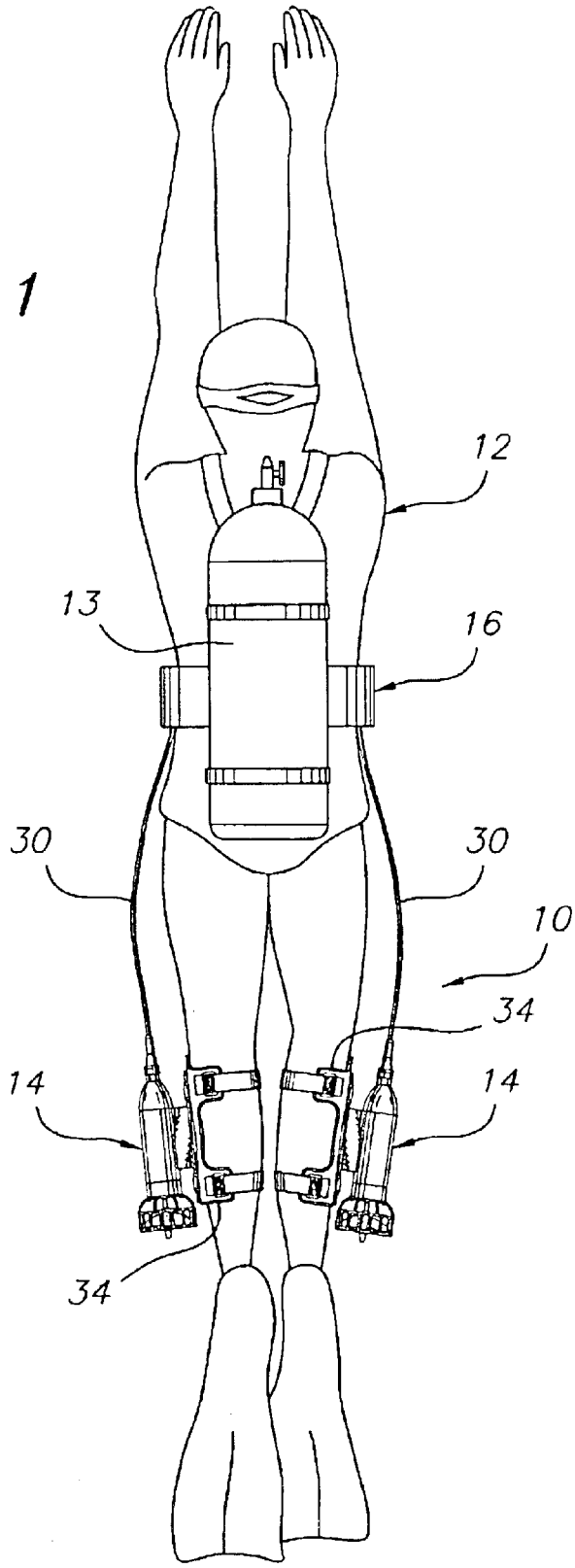
FIG. 1 is a top plan view of a diver equipped with a personal propulsion device.

FIG. 1 shows a personal propulsion device 10 according to this invention as it may be worn or carried in use by a diver 12 or a swimmer. The diver may be a scuba diver equipped with an open circuit air breathing system which typically includes one or two compressed air tanks 13 borne by use of a suitable harness, on the back of the diver. The diver may be a free diver, i.e., one which does not carry an air supply. A user of this propulsion device may be a snorkel diver/swimmer.

Figure 2:
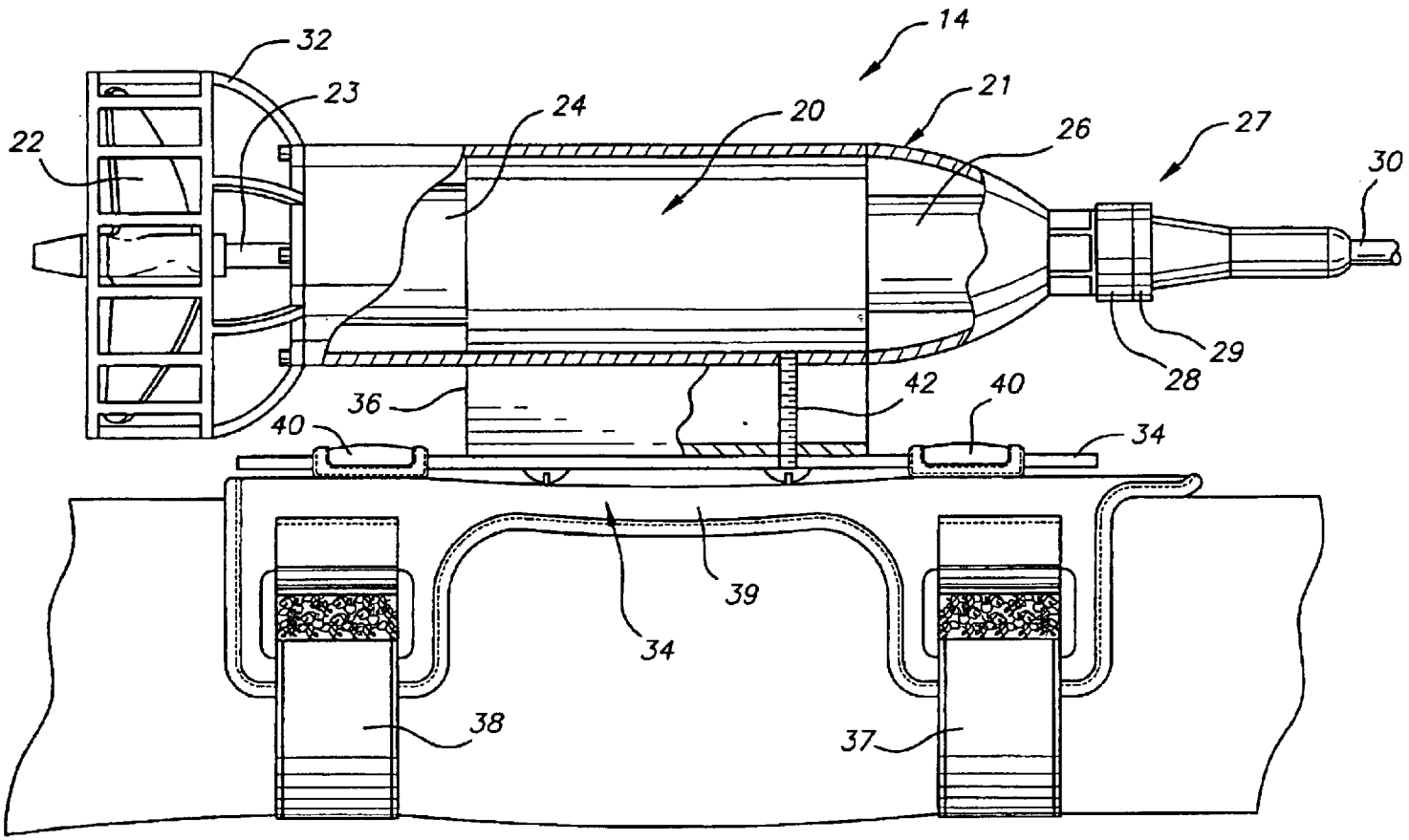
FIG. 2 is an enlarged view, partially in cross-section which shows a propeller and drive motor assembly and how it can be releasably connected to a lower leg of a diver.

Propulsion device 10 is comprised principally by one or, more preferably, two propeller and propeller motor assemblies 14 (FIG. 2), a battery unit 16 (FIG. 3) and a manually operable motor control 18. As shown in FIG. 2, each motor assembly 14 includes an electric motor 20 which is contained in a sealed, water-tight housing 21 which can be cylindrical. A propeller 22 is located outside housing 21 adjacent the rear end of the housing. The propeller is affixed to a rotatable shaft 23 which extends from the housing through redundant shaft seals (not shown) of any suitable kind. Motor 20 can be a brushless DC motor, such as an Aveox 27/39/4 motor which can operate at high speed, i.e., a speed higher than the speed at which propeller 22 is designed to operate. To enable the propeller to be driven at a rotational rate which is lower than that of the motor, shaft 23 can be an output shaft of a speed reducing gearbox 24 which can be located in the rear interior of housing 21 and which has the shaft of motor 20 as its input. The gearbox can be an Aveox gearbox having an input-to-output speed ratio of 4.4:1. The propeller can be about 3¼ inches in diameter with a pitch of 3 inches; such propellers are available and often are used in model racing boats. The normal operating rate of the motor can be around 20,000 rpm, and the propeller turns rate can be on the order of 4500 rpm or so. Consistent with the performance desired in device 10, other combinations of motors, propellers and gearboxes can be used.

Motor 20 can be provided for variable speed operation. To that end, a motor speed controller 26 can be provided in the forward interior of housing 21 with its output terminals coupled directly to the input terminals of motor 20. By placing speed controller 26 in housing 21, a simpler electrical connector set 27, say a three terminal set as opposed to a more costly connector set having as many as eight terminals, can be used to connect a cable 30 to housing 21, as compared to the alternate instance of locating the electronic motor speed controller in control unit 18. The forward end of motor housing 21 can be streamlined, as shown in FIG. 2, and can carry one moiety 28 of the electrical connector set 27. The other cooperating moiety 29 of that connector set can be carried at the end of a waterproof multi-conductor electrical cable 30 which can connect at its other end to control unit 18. Alternatively, cable 30 can extend, in a watertight manner, through the forward end of housing 21 for connection inside the housing of its conductors to the terminals of controller 26 or of motor 20, as desired. Direct connection of the cable conductors to controller 26, rather than via connector set 27, is preferred. A suitable motor speed controller 26 can be an Aveox SL-18 controller.

Propeller 22 preferably is located inside a protective open cage 32 which is affixed to the rear end of motor housing 21. The presence of the cage around the propeller protects the propeller from contacting the body of a user, or of anything (such as a swim fin) worn by the user, during operation of the propeller. If desired in an appropriate instance, the portion of the protective cage radially adjacent the propeller blades can be defined as a shroud of a Kort nozzle; an appropriate instance could be one in which it is planned that the propeller be operated predominantly at a characteristic constant turns rate.

As shown in FIG. 2, motor housing 21, with the propeller carried by it, is adapted by other components of assembly 14 to be mounted in a releasable manner to a leg, preferably a lower leg, of diver 12. Those other components of the assembly can include a flexible sheath-like base 34, a mounting plate 35 and a bracket 36 coupled between the motor housing and plate 35. Base 34 can be a modification of a conventional sheath for a diver's knife. Base 34 can have upper 37 and lower 38 strap and buckle arrangements of known kind and design which enable the base to be releasably strapped to the lower leg of a diver. In a preferred base 34, the leg engaging straps are equipped, at and adjacent their free ends, with Velcro hook material and pile material pieces which afford precise control over the girth encompassed by the straps as secured about a diver's leg. Other forms of strap securement arrangements can be used. The upper and lower strap and buckle arrangements 37, 38 can be located at the opposite ends of a flexible body 39 of the base.

Mounting plate 35 of assembly 14 can be a flat, comparatively rigid and strong member, such as a sheet of carbon fiber reinforced composite material. Plate 35 can be coupled to base 34 by snugged straps 40 secured to the base and passing through slots (not shown) located in the corners of the plate. Bracket 36 can be in the form of a length of upwardly open channel having its web abutting the mounting plate and the edges of its flanges engaged with the exterior of the motor housing. The motor housing, the bracket and the mounting plate can be secured together by screws 42 extending through the mounting plate and the bracket into threaded engagement with the motor housing. In such manner, the motor housing can be securely made a part of the motor assembly which can be mounted to a diver's leg.

As shown in FIG. 1, propulsion device 10 preferably includes a pair of propeller and motor assemblies in accord with the foregoing descriptions. The two motor assemblies can be strapped to the diver's legs as shown, with each assembly connected electrically to a master motor control 18 carried by the diver at his/her waist or at the diver's torso.

Figure 3:
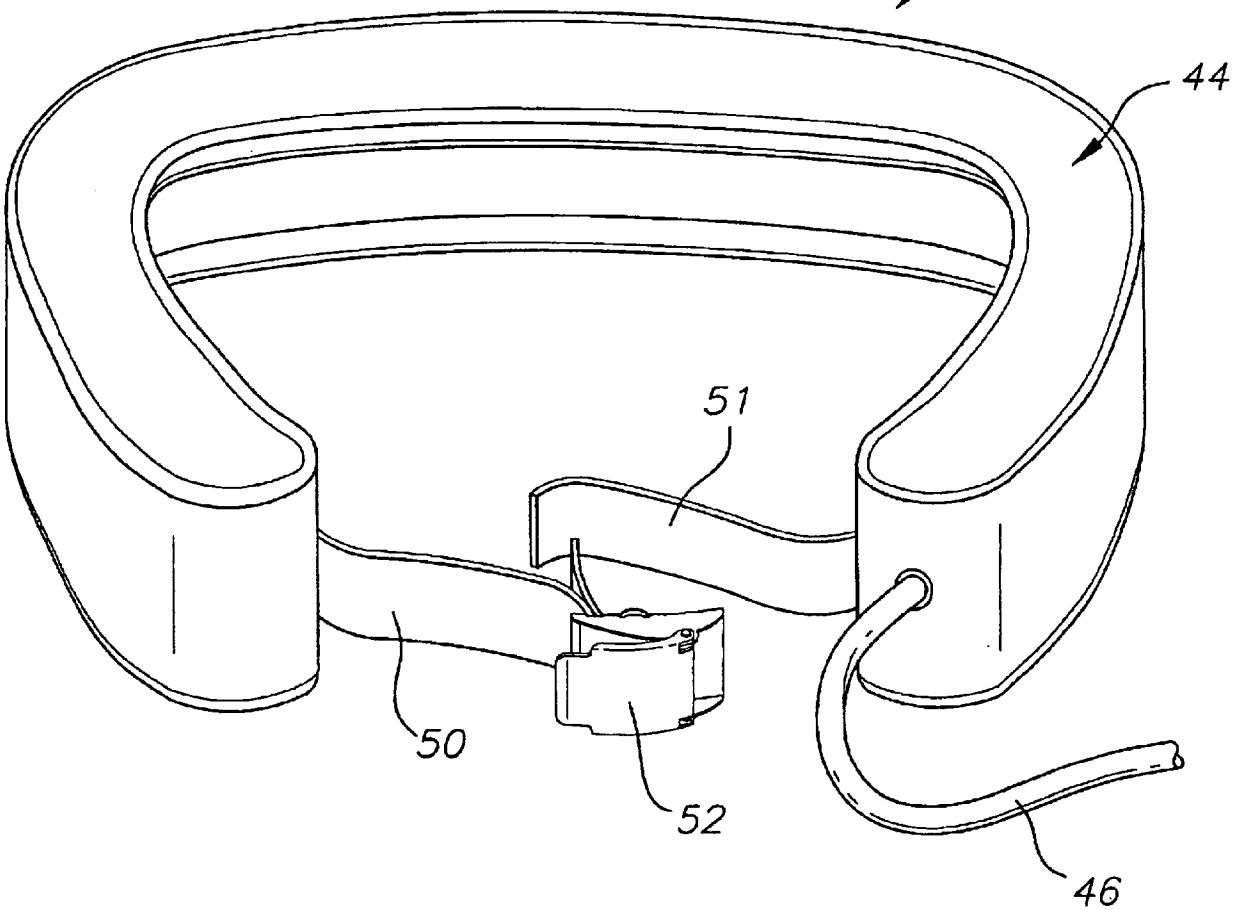
FIG. 3 is a perspective view of a battery unit wearable by a diver in the manner of a belt.

FIG. 3 depicts a belt-like battery unit 16 for propulsion device 10. The battery unit includes an elongate flexible housing 44 which can be defined as a pouch formed of waterproof trilaminate fabric closable by a waterproof zipper (slide fastener). Inside the housing 44 can be a plurality of rechargeable batteries, such as 20 1.2V NiMH (nickel metal hydride) F cell batteries suitably interconnected to each other, as in series. The battery set is connected in turn, inside the housing, to the conductors of a waterproof multiconductor cable 46 which extends through a watertight seal in the housing to motor control 18. At its end opposite from housing 44, cable 46 can terminate at one moiety 47 of a suitable water-tight electrical connector, the other moiety 48 of which is mounted to a motor control enclosure 49. So that the belt-like battery unit can be secured around the waist of a diver, it can carry at its ends a pair of flexible straps 50, 51, one (50) of which in turn carries a releasable clasp or buckle 52 with which the other strap (51) is releasably engagable. The straps and buckle can be like those commonly found as components of a diver's weight belt. Because it has substantial mass, battery unit 16 can be worn in the place of and instead of a weight belt.

Figure 4:
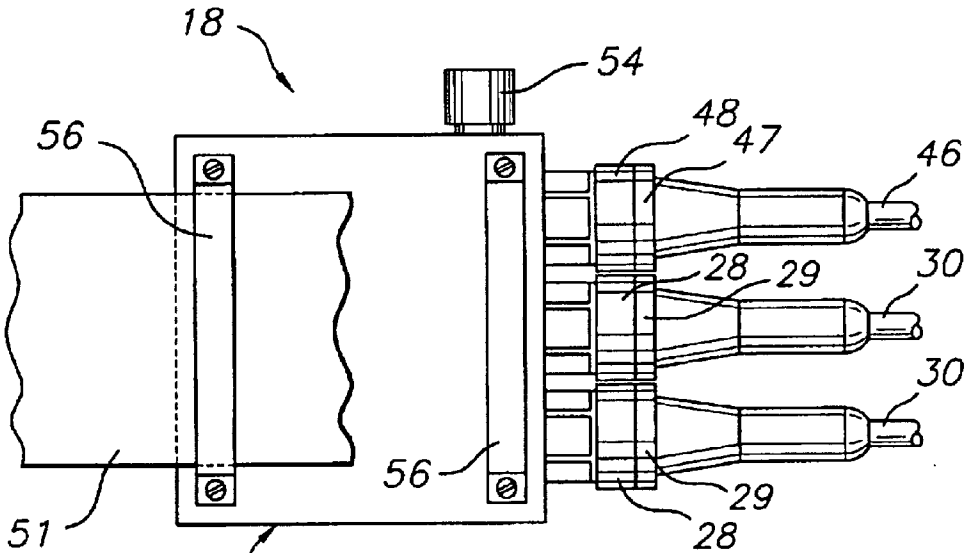
FIG. 4 is a rear elevation view of a motor control component of the propulsion device.

FIG. 4 is a rear elevation view of master motor control 18. It includes a water-tight enclosure 49 to which, as at a side thereof, are mounted watertight electrical connector moieties 28 (preferably two of them) and 48 via which cables 30 and 46 from one or two propeller and motor assemblies 14 and a battery unit can be connected. Within enclosure 49 is a switch which controls ON and OFF states of device 10 and also the speed at which motors 20 are operated. A manually engagable rotatable actuator knob 54 can be mounted to the enclosure for operation by the diver. Knob 54 can operate a potentiometer located within the enclosure and which can include the ON/OFF switch function at one end of its range of operation. As noted above, while enclosure 49 can include the variable speed controlling electronics for motors 20, it is preferred that the motor speed control circuitry for each motor be placed in the respective motor housing 21.

Enclosure 49 is adapted for mounting on one of belts 50, 51 of battery unit 16, or on a separate belt or strap carried either around the diver's torso or on a wetsuit worn by the diver. To afford such mounting capability, a pair of loops are defined on the rear face of enclosure 49 through which the belt or strap can pass. A shown in FIG. 4, those loops can be defined by respective ones of a pair of metal straps or brackets 55 the ends of which are secured to the enclosure but which, between those ends, are spaced from the enclosure surface. Thus, because control 18 is carried by the diver at a location where actuator 54 is readily accessible, the operation of device 10 can be initiated or terminated, and the turns rate of propellers 22 can be set, from time to time as needed with the diver's hands being free for other activities at other times.

The mounting of the propellers and their drive motors on the legs, preferably the lower legs above the ankles, of the diver is consistent with efficient propulsion of the diver who is pushed through the water. When a diver propels himself by use of swim fins, the diver also is pushed through the water by thrust applied to the body via the legs. Also, divers are familiar with, and reflexively rely upon, leg motions to maneuver in the water. The placement of the thrust units 14 on the lower legs of the diver enables the diver to maneuver by use of those familiar leg motions.

Figure 5:
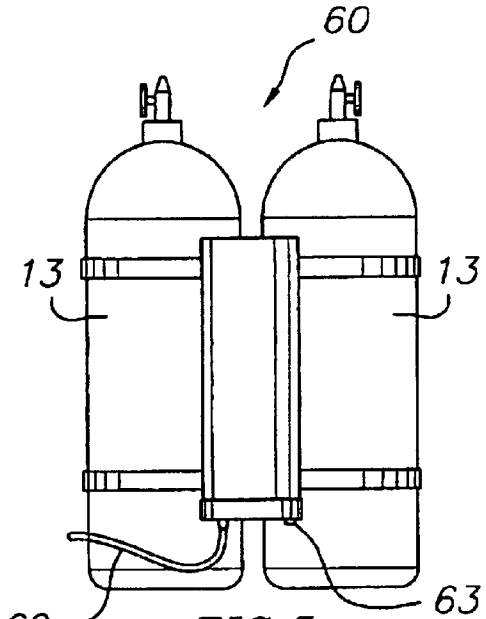
FIG. 5 is a view showing another form of battery unit for the propulsion device.

FIG. 5 shows another battery unit 60 useful in the practice of this invention. Battery unit 60 is comprised by a rigid, sealed, preferably cylindrical housing 61 inside which is disposed an array of plural batteries. For example, 21 1.2V NiMH F or M cells can be disposed in housing 61 in three layers of 7 cells each disposed in a hexagonal array and electrically interconnected to each other. A wet pluggable bulkhead connector passes the battery leads to control unit 18 via a cable 62. The batteries are rechargeable, and a relief valve 63 in the housing wall allows excess gas pressure due to battery recharging to vent from the housing. A similar pressure relief valve can be included in the structure of battery unit 16 if desired.

Figure 6:
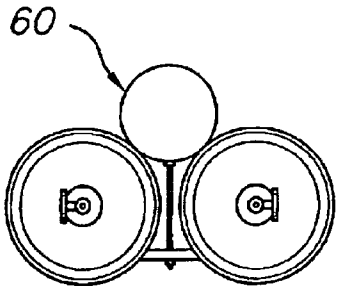
FIG. 6 is an end view of the structure shown in FIG. 5.

Battery unit 60 can be carried by a diver as an additional component of an air tank arrangement in a scuba diving rig. A way to mount the battery unit 60 to a pair of scuba air tanks is shown in FIG. 6. Alternatively, housing 61 can be equipped with its own harness to enable battery unit 60 to be carried on the back of a diver who elects to dive without use of scuba equipment.

The separability of the major components of device 10, as via the disconnectible electrical connectors described above, makes it possible for a spent battery unit to be replaced by a fresh battery unit while the diver is in or under the water. Such battery unit changes can be planned events, or they can occur in response to an emergency.

Personal propulsion devices according to this invention enable divers to travel faster and farther than they can travel in comparable time without such devices. Divers can operate submerged more productively without becoming physically tired, a circumstance which enhances diver safety.

The foregoing descriptions of different embodiments of this invention have been presented illustratively, by way of example, not as an exhaustive catalog of the forms and arrangements by which the invention can be practiced or implemented. Variations and modifications of the structures and procedures described can be practiced or made without departing from the fair scope and content of the invention.

What is claimed is:

1. A powered propulsion device for a human user such as a swimmer or diver comprising:

a propeller and propeller drive electrical motor assembly adapted to be releasably mounted to and carried by a leg of a user between the knee and the ankle with the propeller disposed above the sole of the foot in a standing position of the user and to provide propulsive force to the user in a direction along the leg toward the torso when so mounted and operated, an electrical battery unit adapted to be supported by the torso of the user, a motor control, and, electrical conductors connectible between the motor control, the motor assembly, and the battery unit.

2. A device according to claim 1 in which the motor assembly includes a shroud around the propeller.

3. A device according to claim 1 in which the battery unit is defined substantially as a belt.

4. A device according to claim 3 in which the motor control is connectible to the battery unit.

5. A device according to claim 4 in which the belt includes a releasable closure clasp and the motor control is connectible to the belt in association with the clasp.

6. A device according to claim 1 in which the motor control is physically disconnectible from the battery unit, whereby the battery unit can be exchanged underwater for a different similar battery unit.

7. A device according to claim 1 in which the motor control affords variable speed control of the rotational rate of the propeller.

8. A device according to claim 1 in which the battery unit is connectible to an air supply assembly supportable by the back of a user.

9. A device according to claim 1 in which the battery unit includes a sealed substantially cylindrical battery housing.

10. A device according to claim 9 in which the battery unit includes at least one rechargeable battery in the housing, and the housing includes a relief valve operable to relieve excess gas pressure within the housing.

11. A device according to claim 1 in which the motor assembly comprises a sealed housing in which is disposed an electric motor coupled via a gearbox in the housing to a propeller shaft extending to the exterior of the housing.

12. A device according to claim 11 in which the motor housing includes a motor speed controller operatively coupled to the motor.

13. A powered propulsion device for a human user such as a swimmer or a diver comprising:

a pair of similar propeller and propeller drive electrical motor assemblies each adapted to be releasably mounted to a leg of a user between the knee and the ankle with the propeller disposed above the sole of the foot in a standing position of the user and to provide propulsive force to the user in a direction along the leg toward the torso when so mounted and operated, each assembly including a propeller shield, an electrical battery unit releasably supportable by the torso of the user, a motor control unit manually operable by a user and including a motor speed control, and multi-conductor electrical cables connectible between the motor control unit and each of the motor assemblies and between the motor control unit and the battery unit.

14. A device according to claim 13 in which the battery unit comprises at least one rechargeable battery disposed in a sealed housing, and a gas pressure relief valve communicating through the housing.

15. A device according to claim 13 in which each propeller shield comprises a shroud affixed to a motor housing.

16. A device according to claim 13 in which each motor assembly comprises a sealed housing in which is disposed an electric motor coupled via a speed-reducing gearbox in the housing to a propeller shaft extending to the exterior of the housing.

17. A device according to claim 16 in which each motor housing includes a motor speed controller operatively coupled to the motor in that housing.

* * * * *